US011141031B2

(12) United States Patent
Davila

(10) Patent No.: US 11,141,031 B2
(45) Date of Patent: Oct. 12, 2021

(54) FLOOR CLEANER

(71) Applicant: TTI (Macao Commercial Offshore) Limited, Macau (MO)

(72) Inventor: Rafael Davila, Kannapolis, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 174 days.

(21) Appl. No.: 16/656,844

(22) Filed: Oct. 18, 2019

(65) Prior Publication Data

US 2020/0129021 A1 Apr. 30, 2020

Related U.S. Application Data

(60) Provisional application No. 62/749,839, filed on Oct. 24, 2018.

(51) Int. Cl.

| | |
|---|---|
| ***A47L 9/06*** | (2006.01) |
| ***A47L 5/30*** | (2006.01) |
| ***A47L 9/04*** | (2006.01) |

(52) U.S. Cl.

CPC ..... *A47L 9/0673* (2013.01); *A47L 5/30* (2013.01); *A47L 9/0477* (2013.01)

(58) Field of Classification Search

CPC ... A47L 9/0477; A47L 9/0673; A47L 11/4041
USPC ..... 15/392, 179
See application file for complete search history.

(56) References Cited

U.S. PATENT DOCUMENTS

| | | | |
|---|---|---|---|
| 7,200,893 B2 | 4/2007 | Gerber et al. | |
| 7,805,795 B2 | 10/2010 | Stein et al. | |
| 8,037,571 B2 | 10/2011 | Butts et al. | |
| 8,146,194 B1 | 4/2012 | Farrell | |
| 8,402,601 B2 | 3/2013 | Fahlstrom | |
| 8,720,001 B2 | 5/2014 | Courtney et al. | |
| 8,832,902 B2 | 9/2014 | Kim et al. | |
| 9,844,307 B2 | 12/2017 | Muir | |
| 2012/0084938 A1 | 4/2012 | Fu | |
| 2016/0220082 A1* | 8/2016 | Thorne | A47L 9/0444 |
| 2016/0220084 A1 | 8/2016 | Xu et al. | |

(Continued)

FOREIGN PATENT DOCUMENTS

| | | |
|---|---|---|
| EP | 2289381 A2 | 3/2011 |
| JP | 2011182965 A | 9/2011 |

(Continued)

OTHER PUBLICATIONS

International Search Report and Written Opinion for Application No. PCT/US2019/056880 dated Feb. 24, 2020 (13 pages).

*Primary Examiner* — Orlando E Aviles
*Assistant Examiner* — Sarah Akyaa Fordjour
(74) *Attorney, Agent, or Firm* — Michael Best & Friedrich LLP

(57) ABSTRACT

A floor cleaner including a base that includes a suction inlet, a brushroll chamber, and brushroll. The base further includes a brushroll cover releaseably attached to the base, the brushroll cover removable to access the brushroll chamber. The brushroll chamber includes a brushroll, an endcap, a tab extending from the endcap, a driven end and a non-driven end. The endcap includes the tab extending from the endcap. The tab is movable between an unfolded and a folded position. Upward movement of the tab in the unfolded position removes the brushroll from the brushroll chamber.

26 Claims, 7 Drawing Sheets

(56) References Cited

U.S. PATENT DOCUMENTS

| | | | |
|---|---|---|---|
| 2017/0127896 | A1 | 5/2017 | Carter et al. |
| 2017/0188768 | A1 | 7/2017 | Song |
| 2017/0215667 | A1 | 8/2017 | Thorne et al. |
| 2017/0215676 | A1 | 8/2017 | Moser et al. |
| 2017/0215677 | A1 | 8/2017 | Moser et al. |
| 2017/0215678 | A1 | 8/2017 | Moser et al. |
| 2017/0215679 | A1 | 8/2017 | Moser et al. |
| 2017/0215681 | A1 | 8/2017 | Moser et al. |

FOREIGN PATENT DOCUMENTS

| | | | |
|---|---|---|---|
| WO | 2015052835 | A1 | 4/2015 |
| WO | 2016123345 | A1 | 8/2016 |

* cited by examiner

FLOOR CLEANER

CROSS-REFERENCE TO RELATED APPLICATIONS

This application claims priority to U.S. Provisional Patent Application No. 62/749,839, filed Oct. 24, 2018, the entire contents of which are hereby incorporated by reference herein.

BACKGROUND

The present invention relates to floor cleaners, such as a vacuum cleaner, an extractor-type cleaner, a sweeper, or the like. A floor cleaner may include a surface cleaning head with a debris inlet, and may include one or more mechanical agitators, to contact a surface.

SUMMARY

A floor cleaner is disclosed including a vacuum source and a base movable over a surface to be cleaned. The base includes a suction inlet in fluid communication with the vacuum source, a brushroll chamber, and a brushroll operably positioned in the brushroll chamber. The brushroll has a driven end and a non-driven end, where the driven end of the brushroll is releasably connected to a drive mechanism. An endcap is mounted on the non-driven end of the brushroll, releasably coupled to the base. The endcap includes a tab that is movable between an unfolded and a folded position. Upward movement of the tab in the unfolded position removes the brushroll from the brushroll chamber. A cover is coupled to an upper portion of the base configured to cover a top opening in the brushroll chamber. The cover is movable between a closed and an open position.

Also disclosed is a floor cleaner having a base movable over a surface to be cleaned. The base includes a brushroll chamber and a brushroll operably positioned in the brushroll chamber. The brushroll has a driven end and a non-driven end. The driven end of the brushroll is releasably connected to a drive mechanism. An endcap is mounted on the non-driven end of the brushroll, releasably coupled to the base. The endcap includes a tab that is movable between an unfolded and a folded position. Upward movement of the tab in the unfolded position removes the brushroll from the brushroll chamber. A cover is removably coupled to an upper portion of the base configured to cover the top opening of the brushroll chamber.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
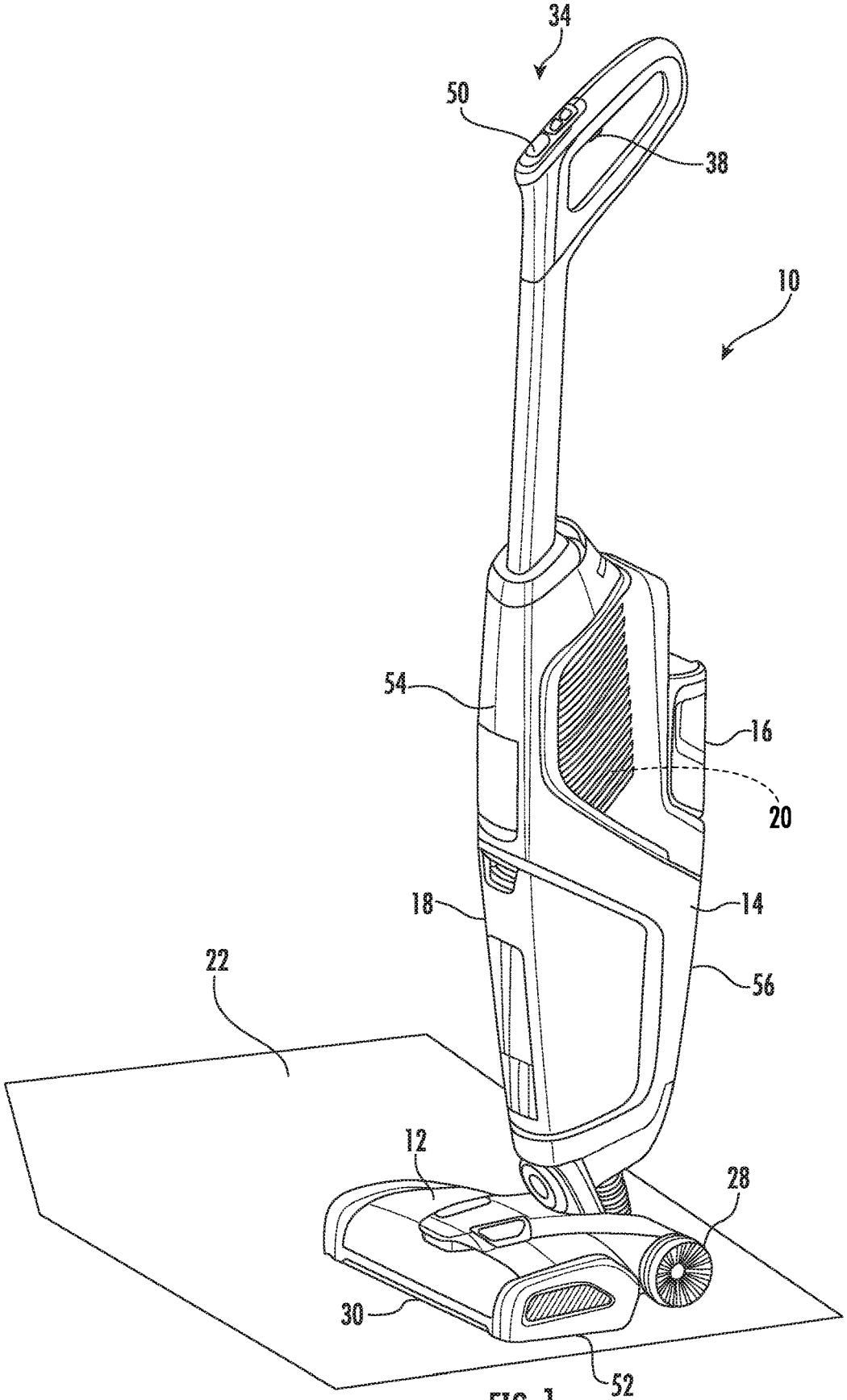
FIG. 1 is a perspective view of a floor cleaner according to one embodiment.
Figure 2:
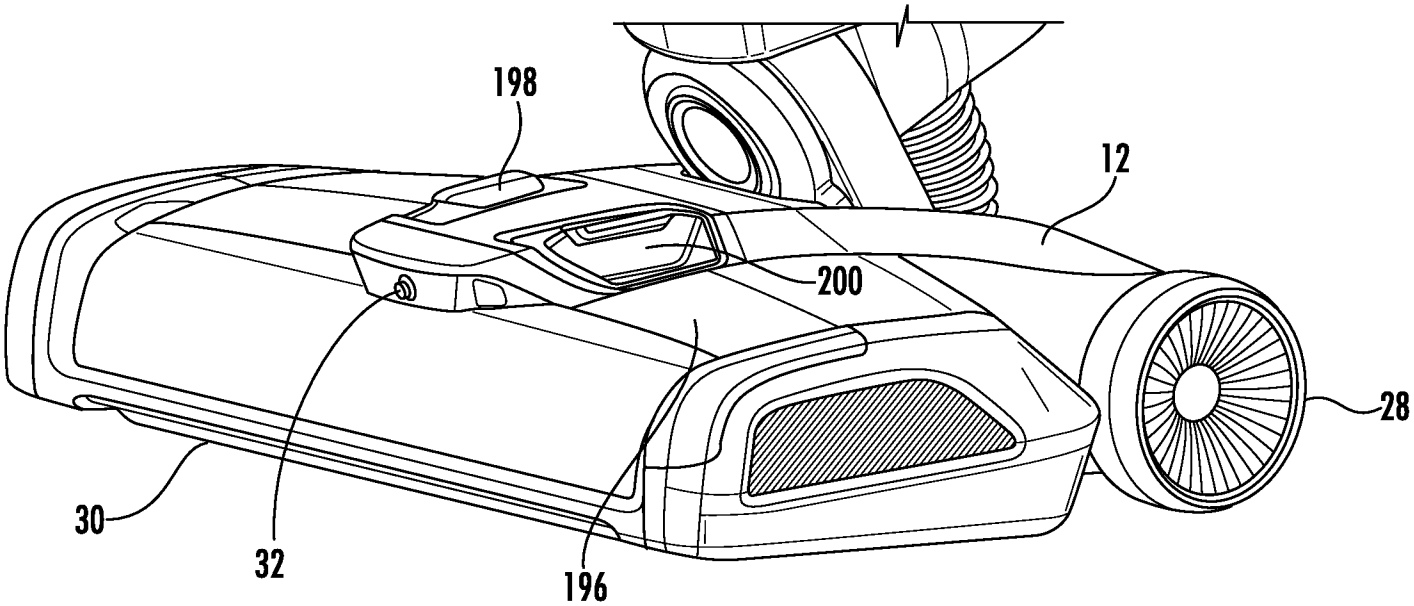
FIG. 2 is a perspective view of the base of the floor cleaner of FIG. 1 with the brushroll cover attached to the base.

FIG. 1 illustrates a floor cleaner 10 having a base 12 and a body 14 pivotally coupled to the base 12. The body 14 is pivotal relative the base 12 between an upright storage position (FIG. 1) and an inclined operating position. The base 12 includes a brushroll 162 operably positioned in a brushroll chamber 194 covered by a brushroll cover 196. The brushroll cover 196 is movable to access the brushroll chamber 194 and brushroll 162, such as by a user to access the brushroll 162 for cleaning or replacement. An endcap 300 is mounted on an end 304 of the brushroll 162, the endcap 300 being releasably coupled to the base 12. A tab 302 extending from the endcap 300 provides a grip for the user to pull the brushroll 162 from the base12 when the cover is in an open position.

The illustrated floor cleaner 10 includes a supply tank 16, a recovery tank 18, and a vacuum source 20. The supply tank 16 is configured to store a cleaning fluid and the floor cleaner 10 is operable to dispense the cleaning fluid onto a surface 22 to be cleaned. The vacuum source 20 includes a motor (not shown) and a fan (not shown). The motor and the fan are operable to draw the cleaning fluid from the surface 22 into the recovery tank 18.

The base 12 is movable over the surface 22 to be cleaned. In the illustrated embodiment, the base 12 includes wheels 28 to facilitate moving the base 12 over the surface 22. The base 12 includes a suction inlet 30 in fluid communication with the vacuum source 20 and the recovery tank 18. The cleaning fluid is drawn from the surface 22 through the suction inlet 30 and into the recovery tank 18. The base 12 further includes a distribution nozzle 32 in fluid communication with the supply tank 16. The distribution nozzle 32 dispenses the cleaning fluid toward the surface 22.

The floor cleaner 10 further includes a handle 34 for the user to control and move the cleaner over the surface to be cleaned and may include an interface such as an actuator 38 to control the flow of cleaning fluid from the supply tank 16 through the distribution nozzle 32.

Referring to FIG. 1, the floor cleaner 10 further includes an upper end 50 and a lower end 52 opposite the upper end 50. The handle 34 is adjacent the upper end 50 and the base 12 is adjacent the lower end 52. The floor cleaner 10 further includes a front side 54 and a back side 56 opposite the front side 54. In one embodiment, the suction inlet 30 is adjacent the front side 54.

The brushroll chamber 194 includes a top opening 195 in an upper portion 201 of the base 12, and a bottom opening 197 in a bottom portion 203 of the base 12. In one embodiment, the brushroll cover 196 is coupled to the upper portion 201 of the base 12 configured to cover the top opening 195 of the brushroll chamber 194. The brushroll cover 196 is movable between a closed position and an open position. The top opening 195 of the brushroll chamber 194 is covered when the brushroll cover 196 is in the closed position. The top opening 195 of the brushroll chamber 194 is uncovered when the brushroll cover 196 is in the open position. In one embodiment, the brushroll cover 196 is removably coupled to the base and configured to cover the top opening 195 of the brushroll chamber 194 when in the closed position.

Figure 6:
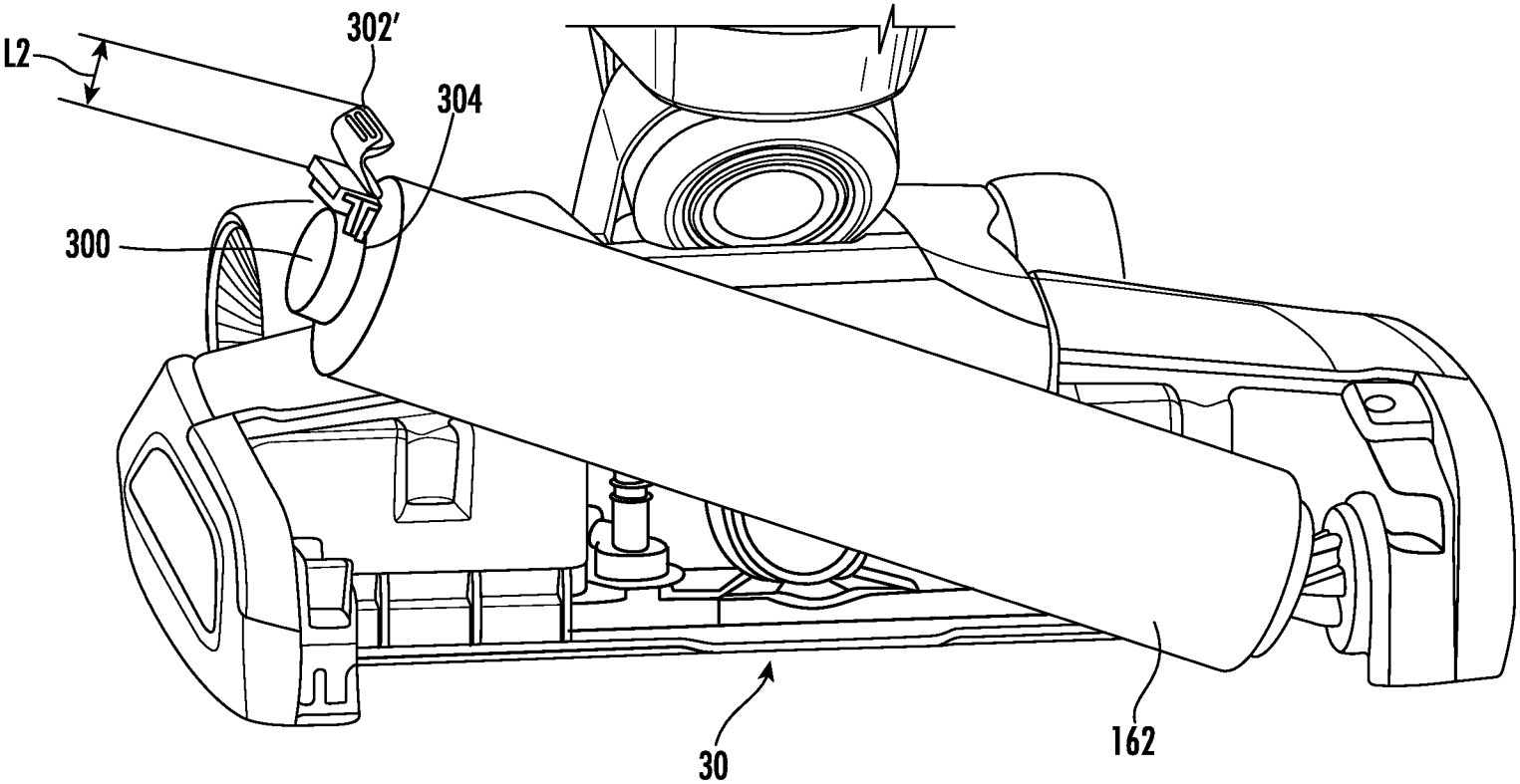
FIG. 6 is a view of the base of the floor cleaner of FIG. 1, where the brushroll cover is removed and the non-driven end of the brushroll is removed from the brushroll chamber.

The brushroll 162 is operably positioned in the brushroll chamber 194 defining a longitudinal brushroll axis 199. The brushroll 162 is rotatable about the brushroll axis 199 and the brushroll 162 extends through the bottom opening 197 of the base 12so that the brushroll 162 contact the surface 22 to be cleaned. The brushroll 162 has a driven end 306 and a non-driven end 304. The driven end 306 of the brushroll 162 is releasably connected to a drive mechanism 310 (FIG. 6). The endcap 300 is mounted on the non-driven end 304 of the brushroll 162 and the endcap 300 is releasably coupled to a cavity 316 in the base 12. The base 12 further includes a bushing 308 operable to constrain the brushroll 162 for rotation. In the illustrated embodiment, the bushing 308 is mounted to the endcap 300.

Figure 3:
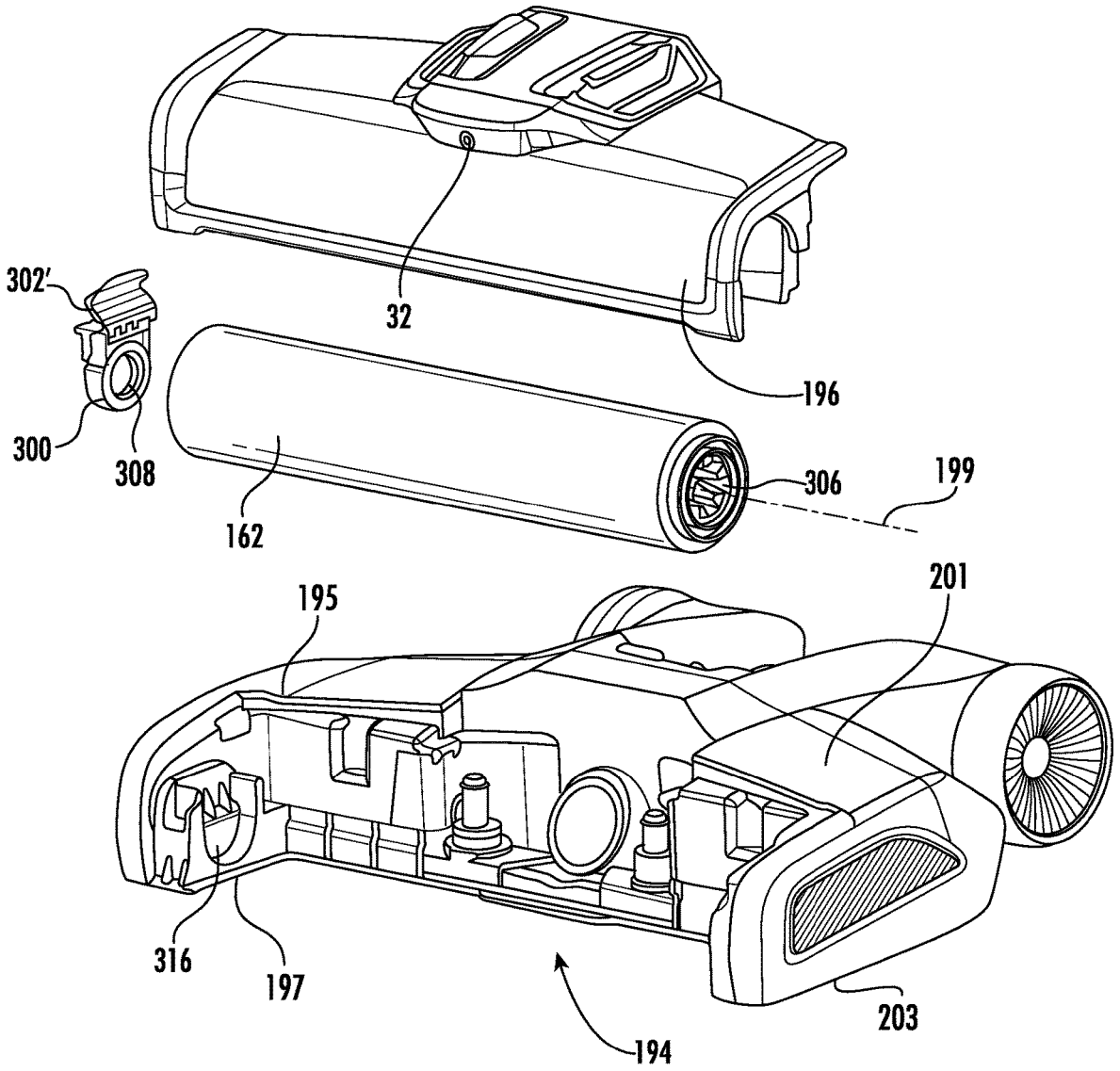
FIG. 3 is a partially exploded view of the base of the floor cleaner of FIG. 1 where the brushroll cover, the brushroll, the endcap, and the tab are removed from the base.
Figure 4:
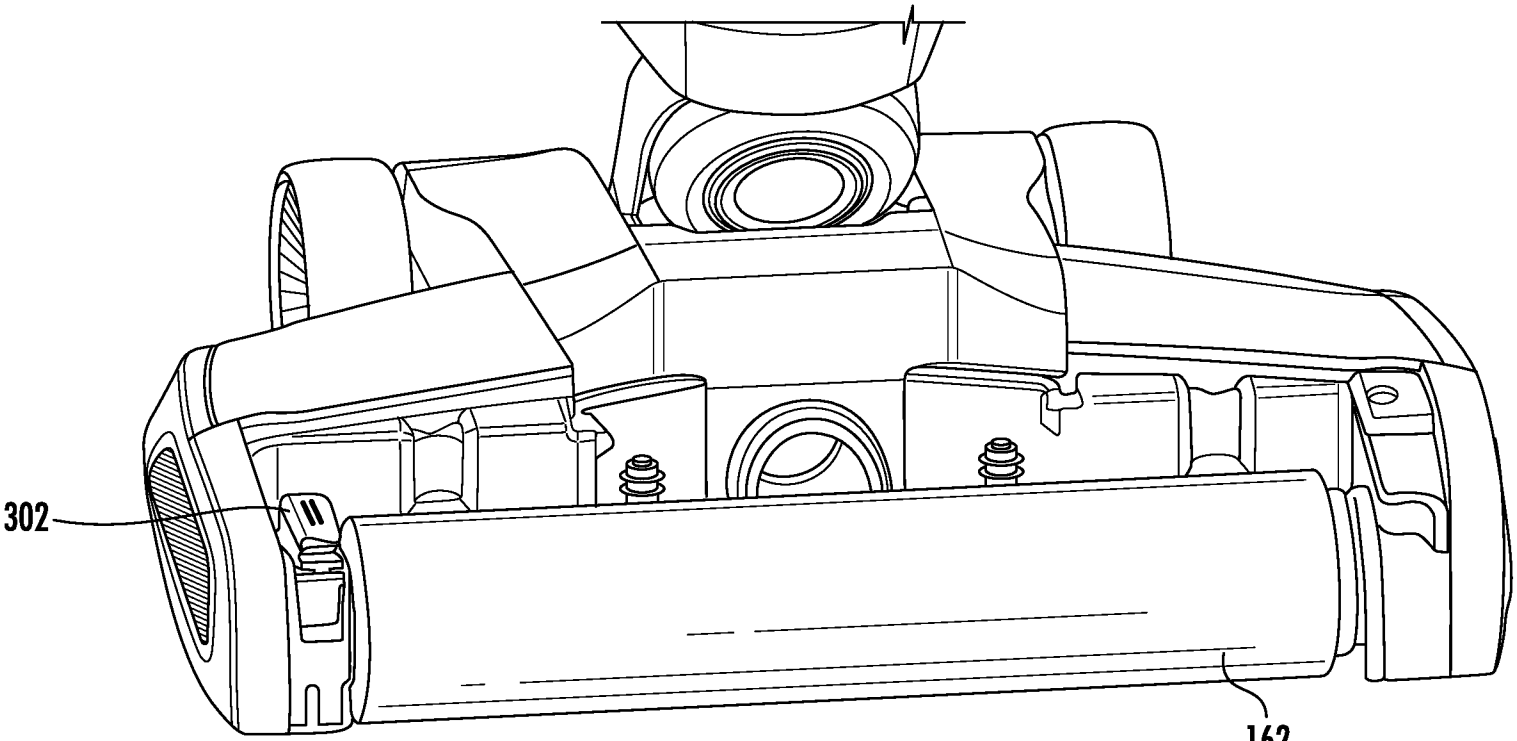
FIG. 4 is a view of the base of the floor cleaner of FIG. 1, where the brushroll cover is removed and the tab is in the folded position.

As shown in FIG. 3, the endcap 300 includes a tab 302 extending from the endcap 300. The tab 302 is movable between an unfolded and a folded position. Upward movement (i.e., generally in a direction from the bottom portion 203 toward the upper portion 201) of the tab 302 in the unfolded position 302' removes the brushroll 162 through the top opening 195 of the brushroll chamber 194 when the brushroll cover 196 is in the open or removed position. In the embodiment shown in FIG. 6, upward movement of the tab 302' releases the endcap 300 from the base 12 such that the brushroll 162 is removable from the brushroll chamber 194 by pivoting about the drive mechanism 310. In one embodiment the endcap 300 is removable from the brushroll 162. In another embodiment the endcap 300 is irremovably coupled to the brushroll 162.

Figure 7:
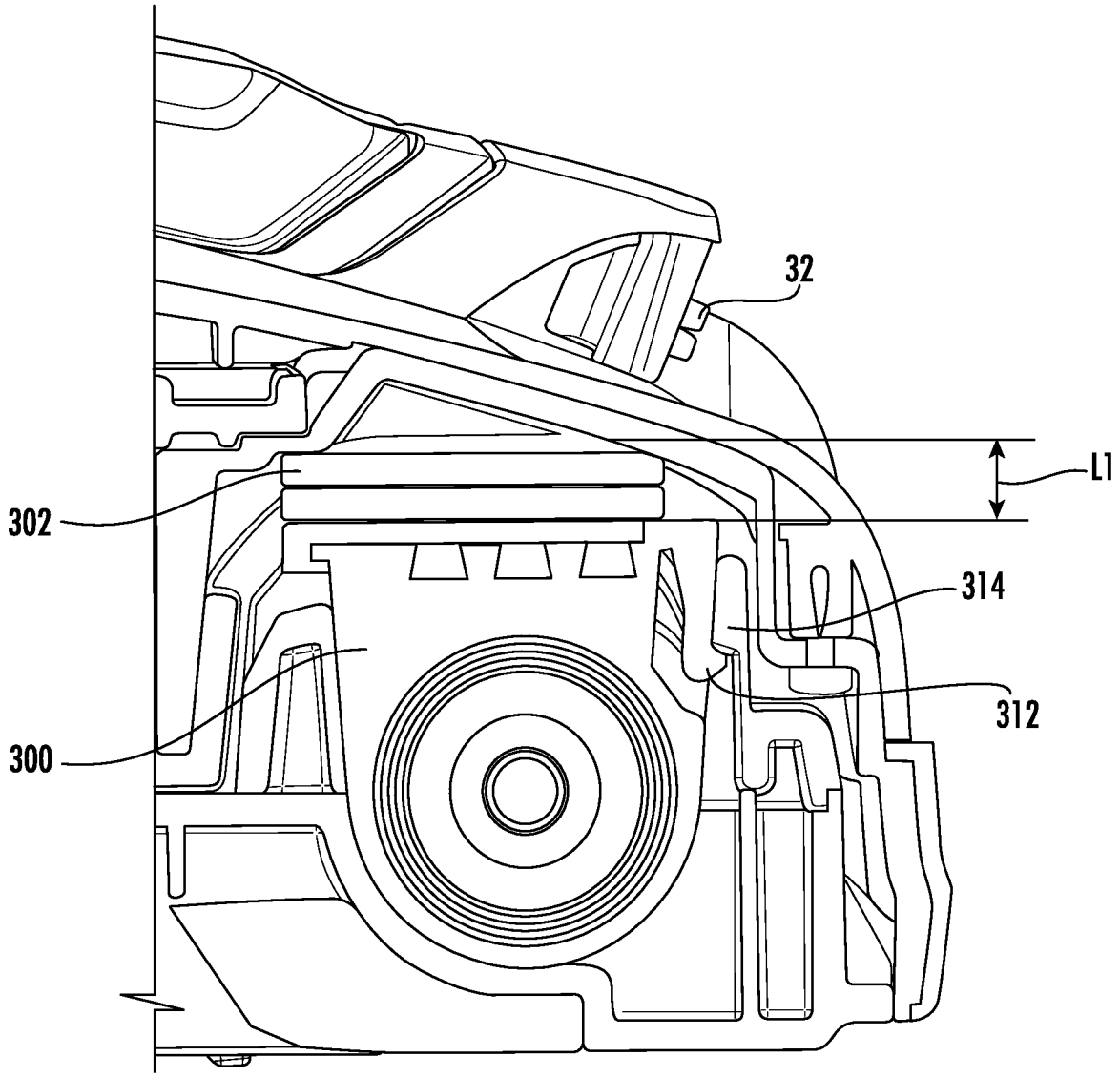
FIG. 7 is a cross-sectional view of the base of the floor cleaner of FIG. 1.

In one embodiment, the tab 302 is positioned beneath the brushroll cover 196 when the cover 196 is in the closed position. When the brushroll cover 196 is secured over the brushroll chamber 194, the brushroll cover 196 holds the tab 302 in the folded position, as shown in FIG. 7. The tab 302 stays in this folded position until the brushroll cover 196 is removed, when the tab 302 is movable to the unfolded position 302'.

The length L2 of the unfolded tab 302' when the brushroll cover 196 is in the open or removed position (FIG. 6) is greater than the distance L1 from the endcap 300 to the brushroll cover 196 when the brushroll cover 196 is in the closed or coupled position (FIG. 7). The ratio of L2/L1 is in the range of 1.5 to 8, and more specifically in the range of 2 to 5. In one embodiment, the ratio of L2/L1 is between 2 and 3.

Figure 5:
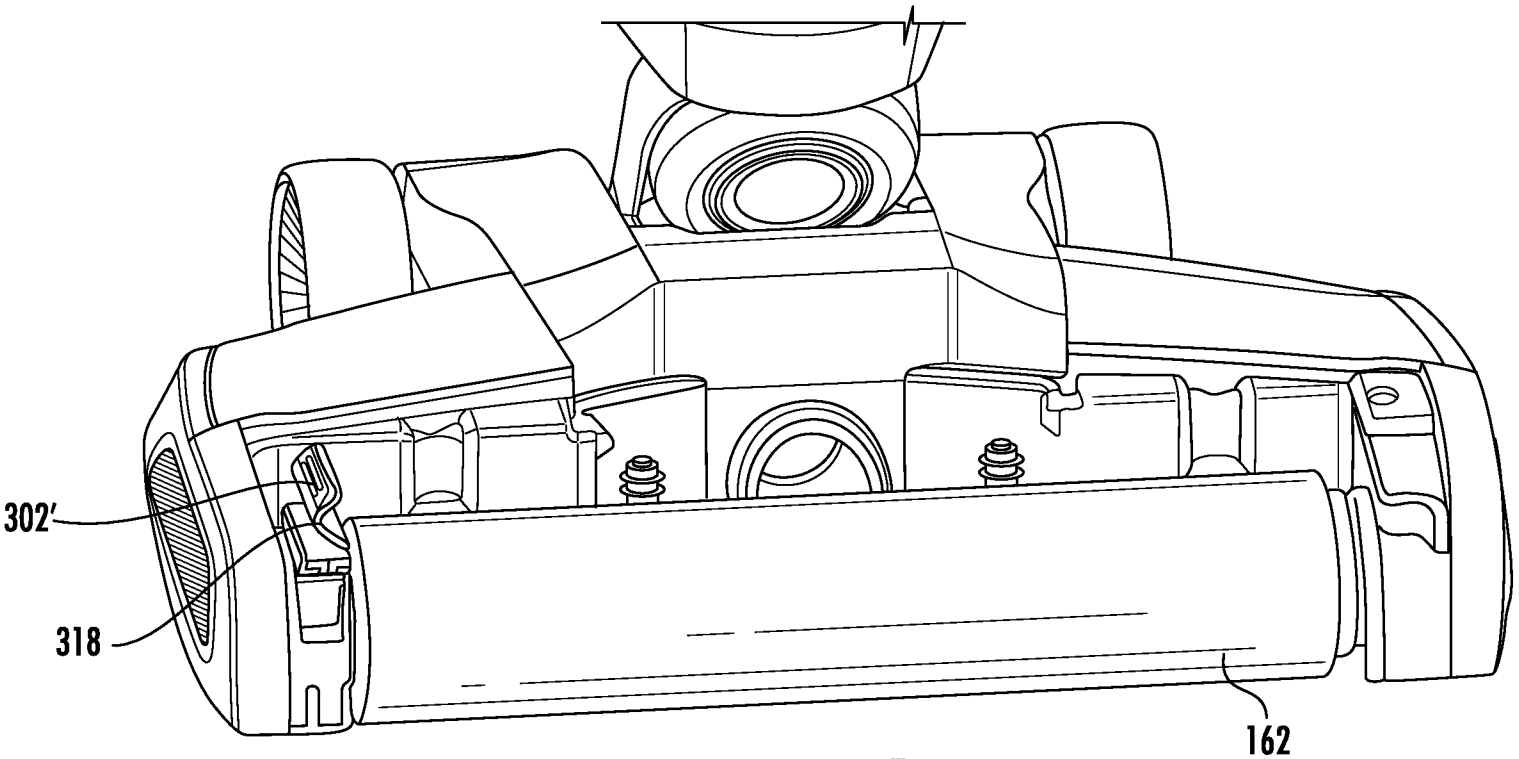
FIG. 5 is a view of the base of the floor cleaner of FIG. 1, where the brushroll cover is removed and the tab is in the unfolded position.

The endcap 300 is made of a rigid material or semi-rigid material selected to provide thermal and physical properties desirable for the brushroll application, such as, for example, nylon or aluminum. The tab 302 may be made of an elastomeric material. In this embodiment, the tab 302 is overmolded to the endcap 300. In another embodiment, the endcap 300 and the tab 302 are made of the same material, the tab 302 integrally formed with the endcap 300 or otherwise secured to the endcap 300. The tab 302 may be formed with a material having resilient properties such that the resiliency of the material moves the tab toward the unfolded position 302' when the cover 196 is removed, as shown in FIGS. 5 and 6.

The tab 302 is foldable along a hinge 318. The hinge 318 can be an integral hinge, a pinned hinge, a strap hinge, or the like. In the illustrated embodiment, the tab 302 moves to the folded position towards the brushroll 162. In one embodiment, the tab 302 folds away from the brushroll 162.

The endcap 300 is releasably connected to the base. The cavity 316 in the base 12 is configured to receive and retain the endcap. In the embodiment shown in FIG. 7, the endcap 300 includes a hook 312 and the base 12 has a corresponding detent 314, engagable with the hook 312 and configured to hold the endcap 300 in place. The hook 312 is releasable from the detent 314 by pulling the tab 302'.

The brushroll cover 196 is releasably connected to the base 12. In the illustrated embodiment the brushroll cover 196 includes a first actuator 198 and a second actuator 200 that are used to remove the brushroll cover 196. The first actuator 198 slides in a first direction to move the actuator 198 from a latched position to an unlatched position. The second actuator 200 slides in a second direction, directly opposed to the first direction, from a latched position to an unlatched position. That is, the first actuator 198 is pushed or pressed by the user in the first direction while the second actuator 200 is pushed or pressed by the user in the opposite direction, thereby allowing removal of the brushroll cover 196. The brushroll cover 196 may be releasable from the base 12 in a linear or a pivotable movement as desired. The brushroll cover 196 may be separated from the base 12 in the opened position or may be connected to the base 12 in the opened position.

In operation, the user may wish to remove the brushroll 162 for cleaning or maintenance. To remove the brushroll 162, the user moves the brushroll cover 196 from the closed position to the open position. The user grasps the tab 302' and moves the tab in an upward direction. The movement of the tab 302 in the upward direction releases the endcap 300 from the base 12 and releases the brushroll 162 from the base.

Although the brushroll with endcap and tab have been described in detail with reference to an extractor-type cleaner, the brushroll with endcap and tab as described herein may be applied to other types of cleaners such as vacuum cleaners and sweepers, and variations and modifications exist within the scope and spirit of the invention. Various features and advantages of the invention are set forth in the following claims.

What is claimed is:

1. A floor cleaner comprising:

a vacuum source; and a base movable over a surface to be cleaned, the base having an upper portion and a bottom portion, the base further including;

a suction inlet in fluid communication with the vacuum source;

a brushroll chamber, the brushroll chamber having a top opening in the upper portion of the base, and a bottom opening in the bottom portion of the base;

a brushroll operably positioned in the brushroll chamber, the brushroll having a driven end and a non-driven end, the driven end of the brushroll being releasably connected to a drive mechanism;

a cover coupled to the upper portion of the base configured to cover the top opening of the brushroll chamber, the cover being movable between a closed position and an open position, wherein the top opening is covered when the cover is in the closed position and the top opening is uncovered when the cover is in the open position;

an endcap mounted on the non-driven end of the brushroll, the end cap releasably coupled to the base;

wherein the endcap includes a tab movable between an unfolded and a folded position wherein upward movement of the tab in the unfolded position removes the brushroll when the cover is in the open position.

2. The floor cleaner of claim 1, wherein a length of the unfolded tab extending from the endcap when the cover is in the open position is greater than a distance from the endcap to the cover when the cover is in the closed position.

3. The floor cleaner of claim 1, wherein the endcap is made of a rigid material and the tab is made of an elastomeric material.

4. The floor cleaner of claim 1, wherein the endcap and the tab are made of the same material.

5. The floor cleaner of claim 1, wherein the tab folds along an integral hinge.

6. The floor cleaner of claim 1, wherein the cover does not engage the endcap.

7. The floor cleaner of claim 1, wherein the endcap is removable from the brushroll.

8. The floor cleaner of claim 1, wherein the tab is foldable towards the brushroll.

9. The floor cleaner of claim 1, wherein the brushroll is displaceable in an upward direction by pulling the tab and releasing the endcap from the base such that the brushroll is removable from the brushroll chamber by pivoting about the drive mechanism.

10. The floor cleaner of claim 1, further comprising a bushing operable to constrain the brushroll for rotation, wherein the bushing is mounted to the endcap.

11. The floor cleaner of claim 10, wherein the brushroll is rotatable about a brushroll axis and extends through the bottom opening of the base configured to contact the surface to be cleaned.

12. The floor cleaner of claim 1, wherein the endcap has a hook and the base has a corresponding detent engagable with the hook configured to hold the endcap in place.

13. The floor cleaner of claim 12 wherein the hook is releasable form the detent by pulling the tab.

14. A floor cleaner comprising:

a base movable over a surface to be cleaned, the base having an upper portion and a bottom portion, the base further including;

a brushroll chamber, the brushroll chamber having a top opening in the upper portion of the base, and a bottom opening in the bottom portion of the base;

a brushroll operably positioned in the brushroll chamber, the brushroll having a driven end and a non-driven end, the driven end of the brushroll being releasably connected to a drive mechanism;

a cover removably coupled to the upper portion of the base to cover the top opening of the brushroll chamber;

an endcap mounted on the non-driven end of the brushroll movable between a coupled position and a released position;

wherein the endcap includes a tab movable between an unfolded and a folded position, wherein upward movement of the tab in the unfolded position moves the endcap to the released position.

15. The floor cleaner of claim 14, wherein a length of the unfolded tab extending from the endcap when the cover is removed is greater than a distance from the endcap to the cover when the cover is coupled to the upper portion of the base.

16. The floor cleaner of claim 14, wherein the endcap is made of a rigid material and the tab is made of an elastomeric material.

17. The floor cleaner of claim 14, wherein the endcap and the tab are made of the same material.

18. The floor cleaner of claim 14, wherein the tab folds along an integral hinge.

19. The floor cleaner of claim 14, wherein the cover does not engage the endcap.

20. The floor cleaner of claim 14, wherein the endcap is removable from the brushroll.

21. The floor cleaner of claim 14, wherein the tab is foldable towards the brushroll.

22. The floor cleaner of claim 14, wherein the brushroll is displaceable in an upward direction by pulling the tab and releasing the endcap from the base such that the brushroll is removable from the brushroll chamber by pivoting about the drive mechanism.

23. The floor cleaner of claim 22, further comprising a bushing operable to constrain the brushroll for rotation, wherein the bushing is mounted to the endcap.

24. The floor cleaner of claim 23, wherein the brushroll is rotatable about a brushroll axis and extends through the bottom opening of the base configured to contact the surface to be cleaned.

25. The floor cleaner of claim 14, wherein the endcap has a hook and the base has a corresponding detent engagable with the hook configured to hold the endcap in place.

26. The floor cleaner of claim 25, wherein the hook is releasable from the detent by pulling the tab.

* * * * *